United States Patent [19]

Zink et al.

[11] 4,098,566

[45] Jul. 4, 1978

[54] RADIALLY-INJECTED STEAM FOR SMOKELESS FLARING

[75] Inventors: John S. Zink; Robert D. Reed, both of Tulsa, Okla.

[73] Assignee: John Zink Company, Tulsa, Okla.

[21] Appl. No.: 779,355

[22] Filed: Mar. 21, 1977

[51] Int. Cl.[2] ..... F23L 7/00

[52] U.S. Cl. ..... 431/202

[58] Field of Search ..... 431/4, 202

[56] References Cited

U.S. PATENT DOCUMENTS

| | | | |
|---|---|---|---|
| 3,697,231 | 10/1972 | Reed | 431/202 X |
| 3,817,695 | 6/1974 | Reed | 431/202 |

*Primary Examiner*—Robert G. Nilson

*Attorney, Agent, or Firm*—Head, Johnson & Chafin

[57] ABSTRACT

Apparatus for the injection of steam for the smokeless combustion of waste gases, comprising an annular chamber of substantially the same inner diameter as the top of the flare stack, the chamber mounted on top of the flare stack and extending outwardly a selected radial distance, and vertically a selected height above the top of the flare stack. Steam is supplied to this annular chamber. A plurality of circumferentially spaced pipes are provided in the top of the annular chamber and are deflected outwardly in radial planes at selected angles. There are a plurality of inwardly and upwardly directed orifices for the injection of steam into the flame of the burning gases above the top of the annular chamber as well as to the gases prior to emergence for burning. Additionally, there may be a plurality of circumferentially spaced radial pipes inserted through the inner wall of the annular chamber in a horizontal plane a selected distance down from the top of the chamber. These pipes extend toward the axis of the stack and contain a plurality of orifices in the top quadrant of the pipes for the injection of steam into the rising flow of gas at a selected distance upstream of the plane of burning.

9 Claims, 11 Drawing Figures

RADIALLY-INJECTED STEAM FOR SMOKELESS FLARING

BACKGROUND OF THE INVENTION

1. Field of the Invention

This invention lies in the field of the flaring of waste gases for smokeless combustion.

More particularly this invention lies in the use of steam applied in a plurality of jets at various points and in various directions, into the rising column of gas upstream of, and into the flame zone.

Still more particularly this invention has to do with a specific type of steam manifold forming the top of the flare stack with the addition of pipes and jets in various geometrical arrangements.

2. Description of the Prior Art

It has long been known that steam injected into and mixed with the column of waste gas moving to the top of the flare stack and/or the injection of jets of steam into the cylindrical wall of the rising column of gas and flame, provides help in several ways in producing smokeless combustion of the gases.

The injection of steam serves three purposes, when applied in different ways. The first way is to provide a thorough mixture of steam and gas upstream of the point of combustion. This provides the chemical components, which, in the high temperature of the flame, are chemically transformed to provide carbon monoxide and hydrogen which burn without smoke.

The second type of action performed by the steam is to provide the aspiration and injection of air which is needed for the combustion of the gas. Since the gas itself is relatively low pressure it cannot, of its own energy, aspirate the necessary combustion air, and the energy of the steam is used for that purpose.

The third action of the steam is to provide high velocity jets which cause turbulent mixing of the steam, the air and the gas, to provide the smokeless combustion.

There are separately two ways in which a smoke-prone gas can be burned smokelessly. One is to provide sufficient air, and sufficiently well mixed steam and air so that all of the carbon in the hydrocarbon gases will be completely burned, and therefore, there will be no carbon left to create a smoke.

The second way smoke-prone hydrocarbon gases and air can be turned smokelessly with steam is to provide a chemical change in the gas, by premixing steam with the gas immediately prior to combustion so that the components that are burned are not carbon and hydrogen, but are carbon moxoxide and hydrogen, which burn with invisible end products, namely, carbon dioxide and water.

Various geometrical arrangements of gas flow and steam flow have been provided in the prior art to utilize one or two of the three requirements for promoting the smokeless combustion. In this invention means are provided for utilizing all of the possible three methods of utilizing steam for creating the smokeless combustion of flare gases.

SUMMARY OF THE INVENTION

It is a primary object of this invention to provide apparatus for the smokeless combustion of flare gases, by injection of steam in such ways as to provide complete premixture of steam and gas prior to the flame zone, to provide for the inspiration and injection of sufficient combustion air and, to provide the turbulence necessary for the complete mixing of steam, gas and air in the flame zone.

These and other objects are realized and the limitations of the prior art are overcome in this invention by providing a steam manifold in the form of an annular chamber of rectangular cross-section, which is attached to the top of the flare stack and has substantially the same inner diameter as the inner diameter of the stack. The radial dimensions and vertical extent of the annular chamber are selected dimensions. For the purpose of premixing steam with the gas flowing to the top of the flare stack, a plurality of radial pipes are inserted through the inner wall of the annular steam chamber, in a horizontal plane, a selected distance down from the top of the chamber where combustion begins. These are directed toward the center of the flare stack and contain a plurality of orifices in the top quadrant of the radial pipes. the orifices may be on a vertical diametral plane on the upper surfaces, with the steam jets moving vertically; or conversely they may be on diametral planes tilted at a selected angle on either side of the vertical, so that the jets and steam will be directed outwardly to each side of the vertical plane through the pipe, so as better to mix turbulently with the gas which flows vertically.

There are a plurality of short vertical pipes spaced in a circle on the top surface of the annular steam chamber. The short vertical pipes have extensions tilted outwardly in radial planes, at selected angles. One or more orifices in each of the pipes directed radially inwardly provide high velocity jets of steam for the turbulent mixing of the gas and steam, and air, which will be aspirated with these jets.

In the upper angular portions of the pipes there are a plurality of orifices directed in a radial plane inwardly and upwardly into the rising column of flame, at the top of the annular chamber. These jets of steam serve to aspirate large quantities of air, which mix turbulently with the flame and promote the complete combustion of the gas.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
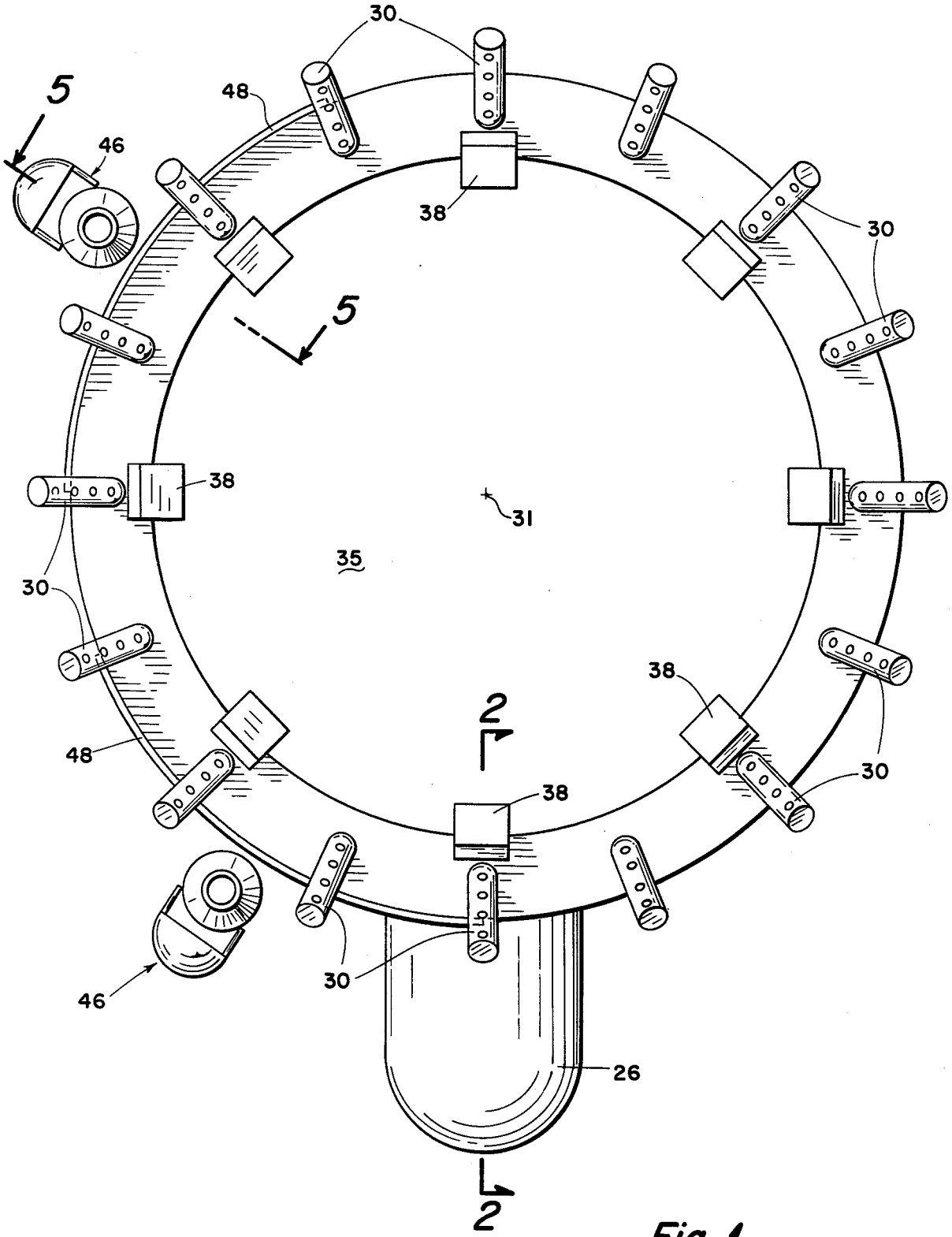
FIGS. 1 and 2 represent respectively plan and elevation views of one embodiment of this invention.
Figure 2B:
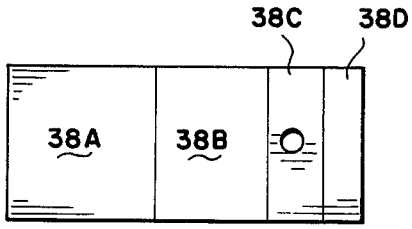
FIGS. 2A and 2B show additional details of FIG. 2.
Figure 2A:
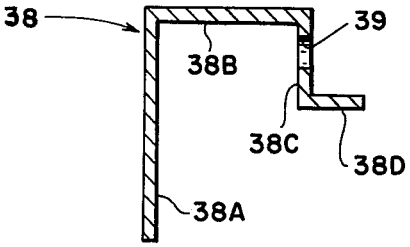
Figure 2:
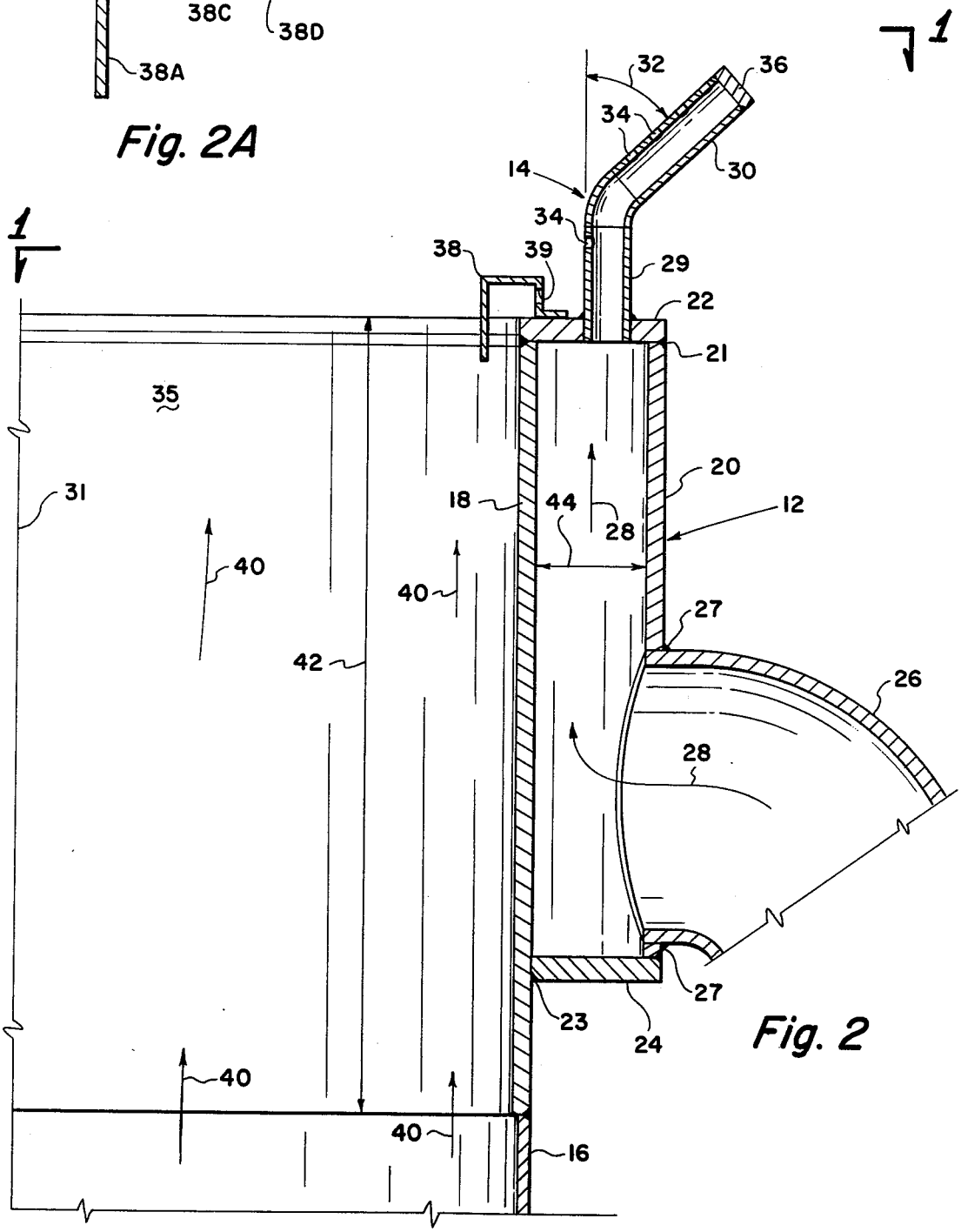

Referring now to the drawings and in particular to FIGS. 1 and 2, there are shown plan and elevation views respectively of one embodiment of this invention. A flare stack of circular cylindrical form 16 has a vertical extension above the top of the stack 16, comprising a cylindrical wall 18 of heavier steel plate than the wall 16. There is a parallel shorter wall 20, which surrounds the wall 18, and there are top and bottom annular rings 22 and 24, all of which are welded together with welds 21 and 23, to provide a rectangular cross-section, annular chamber 12 for use as a steam chamber, or steam manifold. Steam can be supplied to this manifold by pipe 26, for example, and steam will then flow into the chamber in accordance with arrows 28.

The axis of the stack 16 and chamber 20 is indicated by the center line 31. The space inside of the stack is indicated by the numeral 35. The gas to be flared flows vertically in accordance with arrows 40 throughout the cross-section of the space 35.

There are a plurality of short vertical pipes 29 which are inserted through the top annular plate 22 of the annular chamber 12. At the top of the pipes 29 there are extensions 30 which as shown in FIG. 2 may be linear, and positioned at an angle 32 with respect to the vertical, and as shown in FIG. 2, these are in vertical radial planes symmetrically spaced around the plate 22.

While the dimensions of the stack and of the annular chamber can be any selected values, a common dimension for the diameter of the stack might be 24 inch for example. On that scale, the annular chamber might be 2½ to 3 inches in radial dimension 44, and of the order of 1½ feet vertical dimensions 42. The steam pipe feeding steam to the annular chamber or manifold might be a 6 inch pipe, for example. The vertical pipes 29 and 30 might be ¾ inch steel pipe, for example.

There are one or more orifices on the inside of the vertical pipe 29 indicated by numeral 34 which would be in a radial plane. Similarly there are a plurality of orifices along the pipe 30 in a radial plane. The end of the pipe 30 is closed off with a plug 36. The pipes 29 and 30 can be bent from a single piece of pipe or may be welded from straight pieces and an ell 14.

As certain of the vertical pipes 29, there are small baffles 38 welded to the plate 22, which extend over the inner edge 18 of the plate 22 so as to trap some of the rising gas and cause it to flow radially outward through the opening 39 and into the space in front of and below the orifice 34 for example. FIG. 1 shows these baffles 38 to be fewer in number than the number of pipes 29, and 30, in a selected manner.

FIG. 1 shows also two pilot lights 46, mounted adjacent the top of the flare stack. There may be one or more pilots, but there should be at least two, which are preferably spaced 90° apart in the direction of the prevailing winds. A small wind barrier 48, in the form of a sheet of steel welded to the outer edge of the top plate 22, and centered at the point of the pilot light are provided. These barriers serve to provide a quiet space on the inside (lee) side of the barrier, for the assistance of flame ignition by the pilot light. The pilot light 46 (FIG. 5) comprises a tip 50 and a shield 49 which protects the flame from the tip under the influence of wind as indicated by arrow 52. Gas and air mixture is provided by the vertical pipe 52.

Figure 5:
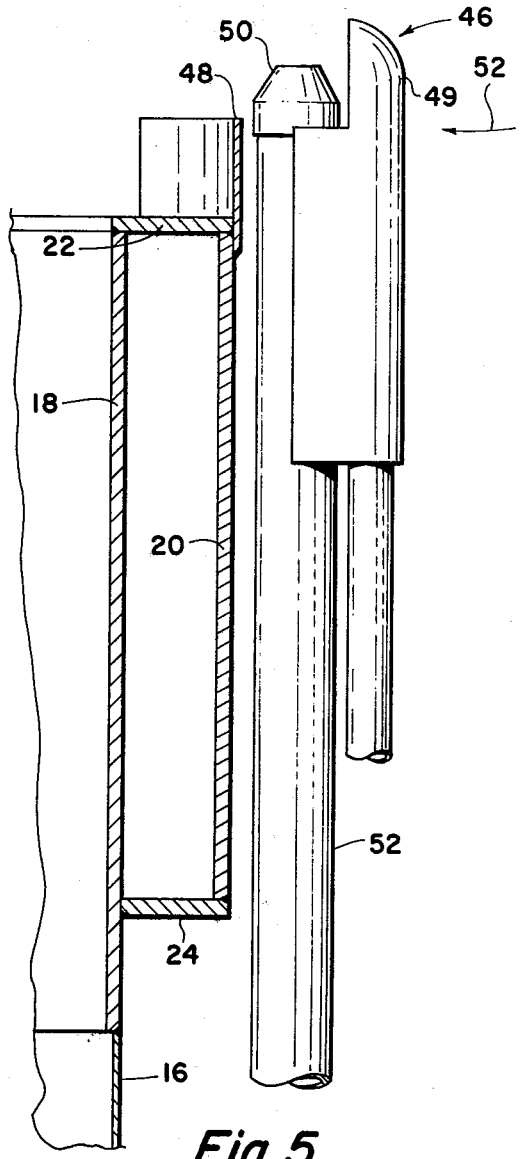
FIG. 5 illustrates one possible arrangement of pilot lights.

Since the design and construction of pilot lights is well covered in the prior art, and since the design of the pilot lights 46 form no part of this invention, further detail of the pilot light as shown in FIG. 5 is not necessary.

Figure 3:
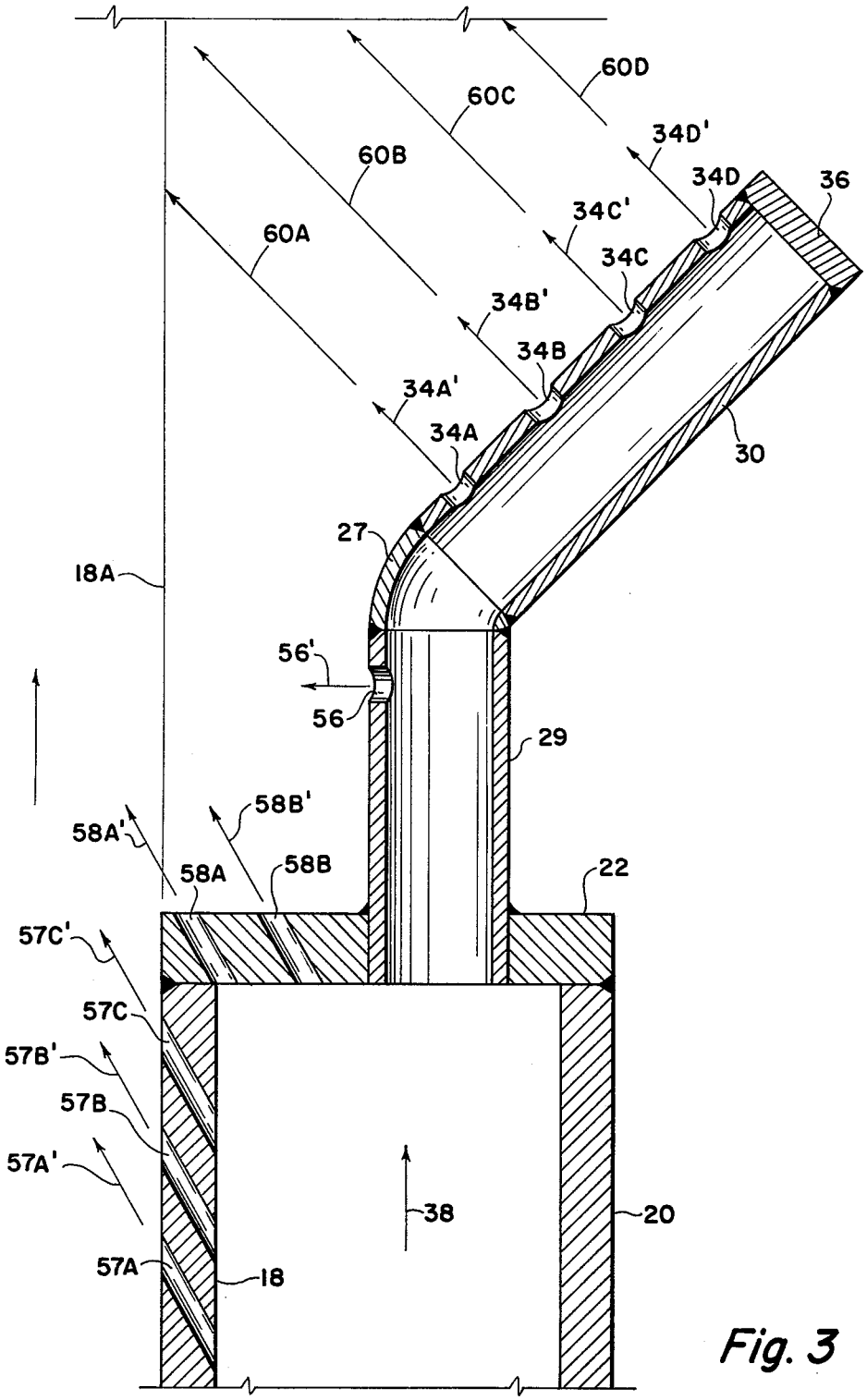
FIGS. 3, 4 and 4A illustrate two embodiments of steam injection means for the aspiration of air into the gas column and the turbulent mixing of gas, air and steam.
Figure 4A:
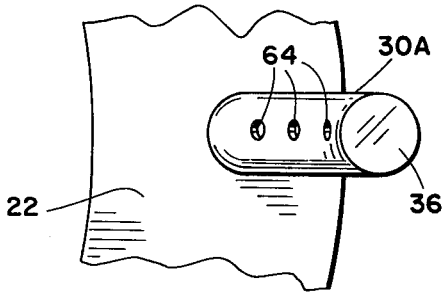
Figure 4:
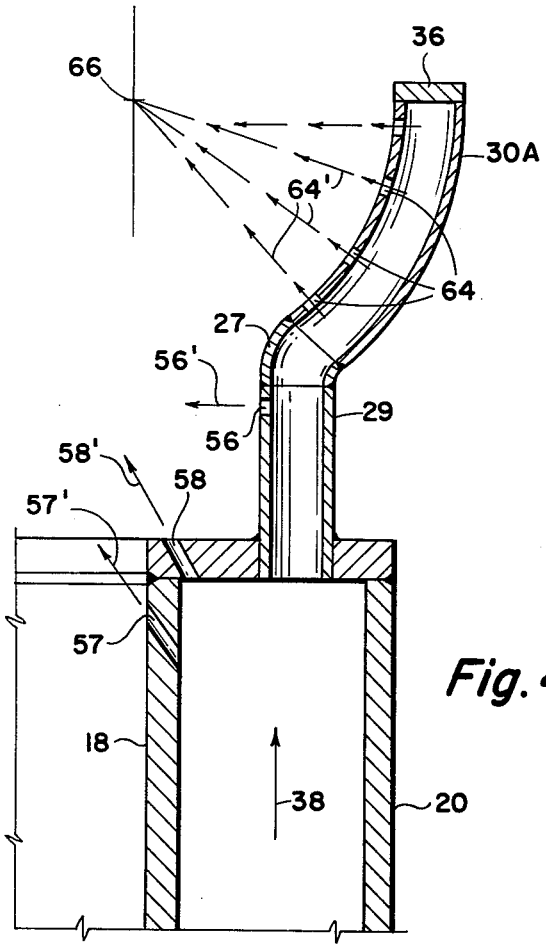

Referring now to FIGS. 3 and 4 there are shown two forms of the pipe structures 29, 27, and 30 in FIG. 3, and 29 and 30A in FIGS. 4 and 4A for injecting steam radially inwardly and upwardly from the pipes leading from the annular steam chamber 12. FIG. 3 illustrates a linear type of pipe similar to that in FIG. 2.

There are also indicated, orifices 57 and 58 which are drilled through the inner wall 18 of the steam chamber, and through the top plate 58 of the steam chamber, respectively.

There are also the orifices 56, and others, which may be placed in the pipe 29, and orifices 34A, 34B, 34C, 34D etc. on the inner face of the pipe 30.

Detailed discussion of the positions of the orifices relative to the internal opening 35 of the flare stack, and the plane of the top of the flare stack, namely the top of the plate 22, will be discussed at length later in the description.

In FIG. 4, the pipe 30A is not linear but is curved, so that the jets of steam 64' which issue from the orifices 64, will converge on a point, such as 66 on the outer wall 18A of the rising column of gas. The line 18A corresponds to an extension of the inner cylindrical wall 18 of the steam chamber 12, and forms the outer wall of the rising column of gas and flame. FIG. 4 also shows the orifices 57 and 58 and 56 as in FIG. 3. A plurality of orifices 57 and of 58 are shown.

Figure 6:
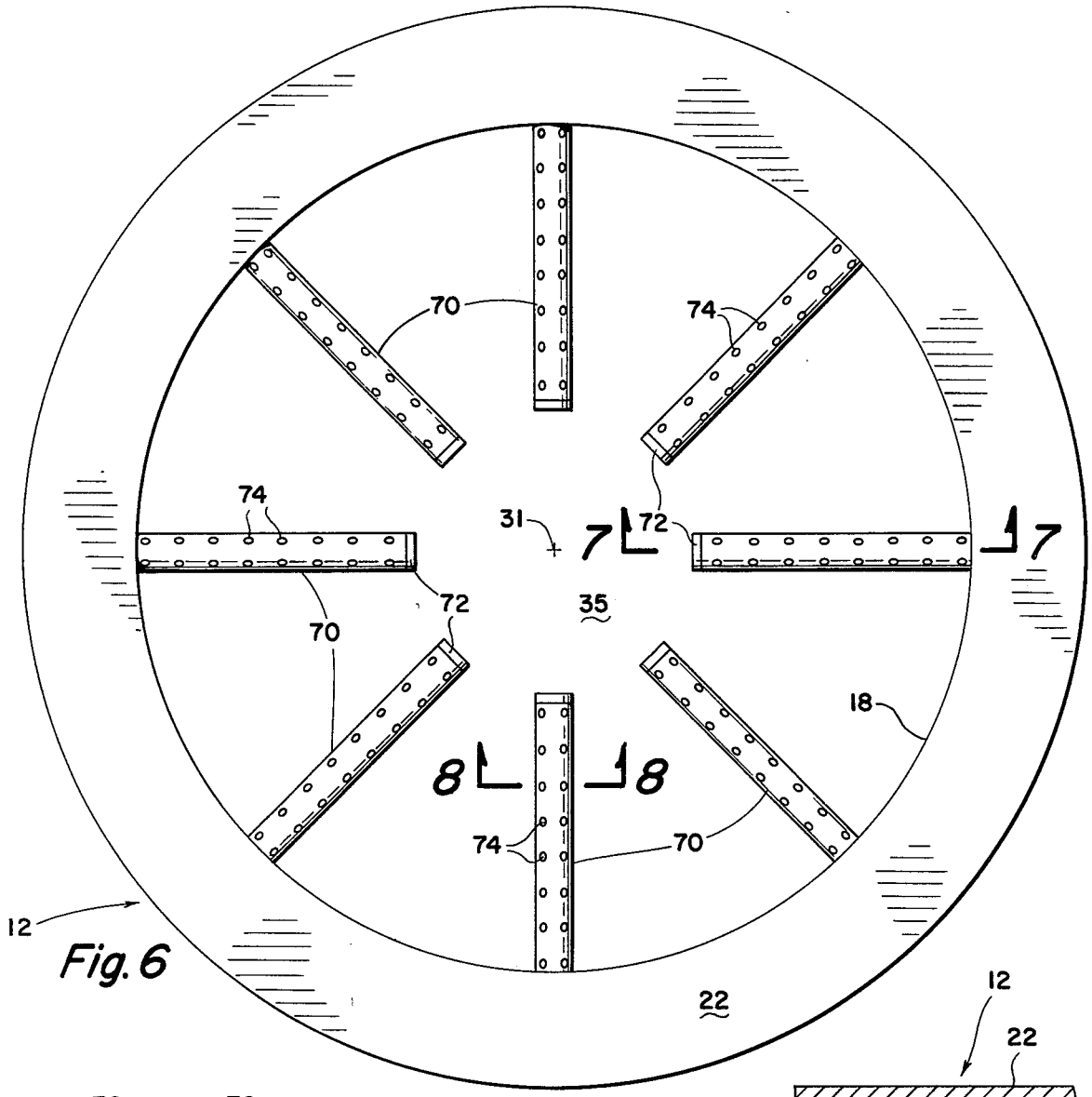
FIGS. 6, 7 and 8 indicate plan and elevation views, and detail of another embodiment of this invention.
Figure 7:
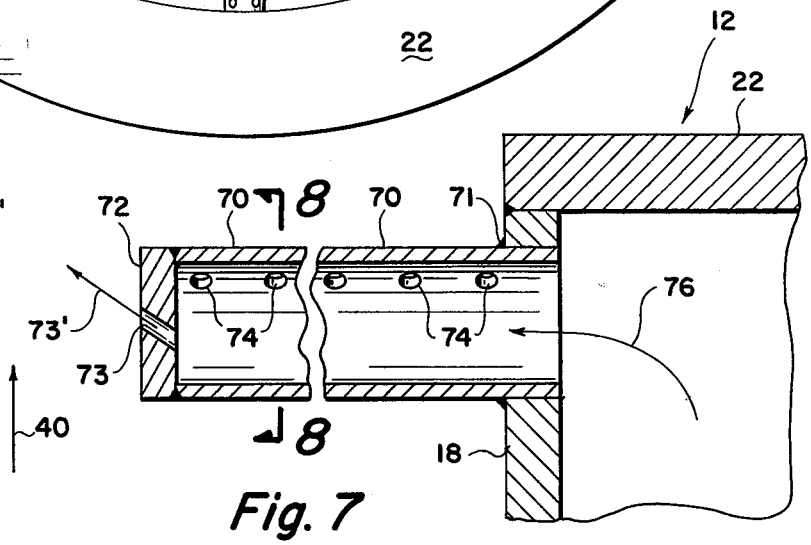

Reference is now made to FIG. 7 which illustrates another embodiment of this invention, which may be used by itself, or in combination with the embodiment of FIGS. 1 and 2. FIG. 6 shows the top view of the annular plate 22 covering the annular steam chamber 12. The inner wall 18 of the steam chamber 12 has a plurality of horizontal radial pipes 70, which are preferably symmetrically spaced around a circumference. These pipes are inserted through the wall 18 and sealed as by welding 71. There are a plurality of openings 74 along the lengths of the pipes 70, which are closed at their inner ends by plates 72.

Figure 8:
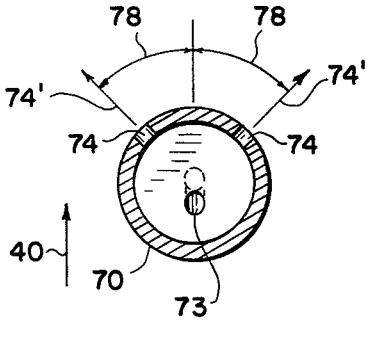

FIG. 8 shows a cross-section through the pipe 70 taken along the plane 8—8, indicating that the openings, ports or orifices 74 are in two longitudinal lines, which are spaced at angles 78 on either side of the vertical axis of the pipe 70. This is one possible arrangement. Another would be to have the openings, or orifices, arranged along the vertical axis of the pipes, with the jets directed upwardly, instead of outwardly. However, the arrangement as shown in FIG. 8 is preferred since it appears to provide greater mixing capability between the outwardly directed steam jets 74' and the rising flow of gas 40.

In addition to the orifices 74 along the length of the pipes 70, there may be one or more inwardly and upwardly inclined orifices 73 in the closure 72 at the ends of pipes 70, which provide steam jets 73', for example. These flow from the plurality of pipes 70 into the center of the cross-section 35, near the axis 31 of the flare stack, and provide steam for mixing with the rising gas in this central column.

As previously explained, the steam may be injected into the gas column in a number of ways. One important way is to inject it into the column of gas upstream of the flame zone so that the steam and gas will be thoroughly mixed as they approach the high temperature flame zone, where the chemical conversion of gas and water vapor to carbon monoxide and hydrogen, can take place. Thus, the combustibles, carbon and hydrogen will then be smokelessly combined into carbon dioxide and water. This is done very effectively by the structure of FIGS. 6, 7 and 8, where the jets 74' provide turbulent mixing with the rising gas 40, so that an adequately turbulent mixture of gas and steam approaches the combustion zone.

There is also need for the presence of adequate quantitites of air for combustion, and since the gas is under low pressure, and thus relatively low velocity, there is little or no opportunity for air aspiration by the gas flow. Consequently, the steam jets from the pipes 29 and 30 are important for the purpose of aspirating and injecting air into the flame and for another turbulently mixing the air, steam and gas.

By using steam which is at least 15 pounds per square inch gauge, that is, at least twice atmospheric pressure, absolute, there will be a drop of pressure in the ratio of 2 to 1 as the steam flows out of the orifices. Under the conditions of a ratio 2 to 1, upstream to downstream pressure for the orifices, the velocity of steam will be substantially sonic, and will provide a very turbulent mixing of the steam with the air and gas.

When the steam jets are in the air, as in FIGS. 1, 2, 3, 4, the steam jets flow into the air, and are rapidly slowed down in moving through the air. This is caused by the intermixing of air, and the consequent acceleration of air, in the process of aspiration. When the steam jets have gone a distance roughly four times the diameter of the orifices, the residual flow energy of the discharged steam from the orifice will be about 83% of the value it was at the exit surface of the orifice. When the steam has gone a distance 8 diameters, the residual flow energy will be aproximately 53%. When it has gone 12 diameters, the residual flow energy will be approximately 24%. When it has gone 16 diameters, the residual flow energy will be approximately 15% and at 18 diameters, it will be about 11%. Thus it is seen, that as the steam jets travel a greater distance from the orifice through air into the gas and flame column a greater quantity of air is inspirated, and as they flow a greater distance, they have less residual energy, and therefore provide less turbulent mixing. However, on the other hand they carry a larger quantity of air, which has been intermixed with the steam in its flow from the orifices.

It is thus seen that orifice 57, for example, provides a steam jet 57' which flows directly into the gas, at high velocity, providing very turbulent mixing. The orifice 58 on the top of the plate 22 provides a jet 58' which flows a very short distance through air, into the wall of the rising column of gas and flame. This jet 58' does not supply very much air since it has not had an opportunity to aspirate and pick up air, but it does provide turbulent mixing. The jet 56' on the side of the pipe 29 is farther from the wall 18A of the flame zone so the jet 56' will have travelled a greater distance, and will have picked up more air than the jet 58', so that jet 56' will bring in considerable air and still have considerable energy for the mixing of the air into the flame.

The jets 34A', 34B', 34C', 34D', etc. are arranged so that they are individually and progressively farther from the wall of the flame 18A, along the axes of the jets. Thus proceeding out along the pipe 30, the farthest jet 34D' will have carried a lot of air into the flame, but will not have projected into the flame very far because of its low residual flow energy. On the other hand, the closestin jet 34A', will have more residual flow energy but less air. It is clear therefore that by designing the orifices such as 56, and the positioning of the pipes 29 and 30 at selected radial distances from the inner edge of the steam chamber and at selected angles, the proper relationship of residual flow energy and intermixed air, can be selected depending on the vertical position in the flame above the top of the plate 22.

FIG. 4 shows a different arrangement than in FIG. 3 wherein all of the orifices 64 are substantially equally spaced from the wall 18A of the flame and therefore this flow can be positioned a selected distance which would carry in a selected volume of air, and still have a selected remanent flow energy. Furthermore, the flow can be concentrated at a "focal point" or time, to provide a greater turbulence than is possible by the arrangement of FIG. 3 for example.

What has been described as a system of steam jets arranged on the surfaces of an annular steam chamber, which forms the top portion of a flare stack. A multiplicity of orifices can be provided over the surface of the chamber and along vertical, or curved, pipes in the top of the chamber, each designed to provide steam at a selected velocity and a selected direction either directly into the steam upstream of the outlet of the flare stack, or into the gas column and flame above the top of the flare, through short or medium distances through the air, to entrap air, as well as to provide turbulence, and through vertical or curved pipes, to provide jets of steam which carry in larger amounts of air, but have less residual flow energy and therefore provide less turbulent mixing. Thus, this arrangement of steam chamber and orifices can provide all three methods of application of steam to the flowing gas column, to provide smokeless combustion.

In addition, there is shown in FIGS. 6, 7 and 8, a further improvement, which provides steam for only one purpose namely the high velocity injection and turbulent mixing with the gas, upstream of the flame zone. However, this invention includes a combination of the apparatus of FIGS. 6, 7 and 8 with the apparatus of FIGS. 1, 2, 3, 4 and 5. Therefore this combination provides optimum presentation of steam, to the gas, for maximum effectiveness in creating smokeless combustion.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. In a flare stack of selected height and selected inner diameter D, through which waste combustible gases flow upwardly to the top of the stack, and including pilot flame means for ignition of the gas, the improvement in steam injection apparatus for smokeless combustion, comprising:

(a) an annular steam chamber of rectangular cross-section, the inner wall of said chamber of diameter D, forming a vertical extension of said flare stack, said chamber having an outer wall of selected height, and selected radius greater than D, and top and bottom closure plates in the form of annular rings; and including conduit means to conduct steam to said chamber;

(b) a plurality of circumferentially spaced pipes set into and sealed to said top closure plate of said chamber at selected angles;

(c) a first plurality of orifices drilled through the inner wall of said chamber inwardly in radial plans, said orifices spaced circumferentially in at least one horizontal row at a selected distance upstream of said top plate;

(d) a second plurality of orifices drilled through said top plate of said chamber radially inwardly and upwardly, spaced circumferentially in at least one circle concentric with said top plate, and at a selected radial distance from the inner edge thereof;

(e) a third plurlaity of orifices drilled through the inner walls of said pipes, said orifices providing steam jets radially and inwardly directed from points a selected distance above said top plate of said chamber;

whereby the first steam jets from said first orifices turbulently mix with the waste gases upstream of the flame zone; the second steam jets from said second orifices intersect the column of gas and flame above said top plate, after transmission through the air over selected short distance; and the third steam jets from said third orifices intersect said flame column after travel through the air for selected longer distances.

2. The apparatus as in claim 1 including a plurality of radial horizontal pipes inserted into the inner wall of said annular chamber in a horizontal plane a selected distance upstream of the flame zone, and closed at their inner ends, a plurality of orifices along the upper surface of said horizontal pipes.

3. The apparatus as in claim 2 in which said plurality of orifices lie along the top center line of said horizontal pipes.

4. The apparatus as in claim 2 in which said orifices lie along two lines at the intersection of two diametral planes at selected angle both sides of the vertical.

5. The apparatus as in claim 2 including at least one orifice in the closed end walls of said horizontal pipes, said orifices directed inwardly and upwardly.

6. The apparatus as in claim 1 in which said plurality of pipes sealed to said top closure plate comprise a first part which is vertical, and a second part is tilted radially outwardly.

7. The apparatus as in claim 6 in which said second part is a linear pipe at a selected angle outwardly of the vertical.

8. The apparatus as in claim 6 in which said second part is curved in the arc of a circle of selected radius.

9. The apparatus as in claim 1, including, in association with each pilot light a short vertical baffle attached to the outer wall of said steam chamber as a wind shield.

* * * * *